US006652091B2

(12) United States Patent
Tanno

(10) Patent No.: US 6,652,091 B2
(45) Date of Patent: Nov. 25, 2003

(54) IMAGE FORMING DEVICE

(75) Inventor: Koichi Tanno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/134,547

(22) Filed: Apr. 30, 2002

(65) Prior Publication Data

US 2002/0167557 A1 Nov. 14, 2002

(30) Foreign Application Priority Data

May 10, 2001 (JP) ..... 2001-139895

(51) Int. Cl.[7] ..... B41J 2/15; B41J 2/01; B41J 11/58; B41J 13/10; B41E 13/24

(52) U.S. Cl. ..... 347/104; 400/625; 101/232; 347/20; 347/101

(58) Field of Search ..... 347/104, 20, 101; 400/625; 101/232

(56) References Cited

U.S. PATENT DOCUMENTS 4,888,602 A * 12/1989 Watanabe et al. ..... 346/134
5,141,346 A * 8/1992 Nakagawa ..... 400/605
5,291,224 A * 3/1994 Asano et al. ..... 346/134
5,517,226 A * 5/1996 Uehara et al. ..... 347/104
5,534,894 A * 7/1996 Hirano et al. ..... 346/134
5,536,000 A * 7/1996 Kelly ..... 271/189
5,603,493 A * 2/1997 Kelly ..... 271/188
5,636,929 A * 6/1997 Asano et al. ..... 400/641
5,697,716 A * 12/1997 Akahane ..... 400/624
5,774,151 A * 6/1998 Sugitani et al. ..... 347/63
5,946,016 A * 8/1999 Saito et al. ..... 347/104
6,027,269 A * 2/2000 Yoshida ..... 400/625
6,092,892 A 7/2000 Taniguro et al.
6,238,114 B1 * 5/2001 Bennett et al. ..... 400/625
6,293,670 B1 9/2001 Taniguro et al.
6,322,068 B1 * 11/2001 Iemura et al. ..... 271/177

* cited by examiner

*Primary Examiner*—Judy Nguyen
*Assistant Examiner*—Leonard Liang
(74) *Attorney, Agent, or Firm*—Fitzpatrick, Cella, Harper & Scinto

(57) ABSTRACT

A recording device includes a guide protruding from and retracting toward a platen and a discharge support protruding from and retracting toward the guide. With this arrangement, the process for fabricating the parts of the device is not complicated, a large space for the discharge support is not needed, and a required flatness of the upper surface of the platen is easily obtained even when the device includes the discharge support.

18 Claims, 16 Drawing Sheets

IMAGE FORMING DEVICE

BACKGROUND OF THE INVENTION

1. Field of the Invention

The present invention relates to a recording device having a transport mechanism for transporting a recording medium such as a sheet of paper on which a recording head performs recording.

2. Description of the Related Art

In general, ink-jet recording devices perform recording on a recording medium by allowing a recording head to discharge flying ink drops. Such recording devices have various advantages such as an easy reduction in the size of the recording head, performing accurate and high-speed recording, a low running cost, low noise due to non-impact features, and easy forming of a color image by using a variety of color inks.

In such an ink-jet recording device, a recording sheet on which the recording head has performed recording is held by a platen in a recording area and is discharged by a discharge section disposed downstream in the transport direction of the recording sheet.

With reference to FIGS. 14 to 17, a known ink-jet recording device will be described. FIG. 14 is a perspective view illustrating the overall structure of a known ink-jet recording device 1. FIG. 15 is a sectional view illustrating the overall structure of the known ink-jet recording device 1. FIG. 16 is a perspective view schematically illustrating the positional relationship among a transport roller, a pinch roller, spurs, discharge rollers and so forth in the known ink-jet recording device 1. FIG. 17 is a sectional view schematically illustrating the positional relationship among the spurs, discharge rollers and so forth in the known ink-jet recording device 1.

As shown in FIG. 15, recording sheets P, as recording media, are stacked on a feeding section 2 and are fed sheet by sheet from the top of the stack by a feeding roller 22. The recording sheet P fed by the feeding roller 22 is supported by a transport roller 36 and a pinch roller 37 while being sandwiched therebetween and is transported to the start point of recording on a platen 34 by the transport roller 36 which is driven by a drive source (not shown).

A recording head 7 is detachably mounted on a carriage 50. The carriage 50 is movably mounted on a shaft 81 in a direction orthogonal to the transport direction of the recording sheet P. In other words, the recording head 7 performs recording while moving in a direction orthogonal to the transport direction of the recording sheet P.

A discharge roller shaft 41 is driven by a drive force of the transport roller 36 via a transmission roller 40. As shown in FIG. 16, the discharge roller shaft 41 has a plurality of discharge rollers 41*a* made from elastomer or gum mounted thereon for transporting the recording sheet P. Spurs 42 press-contacting the corresponding discharge rollers 41*a* have a sharp-edged periphery in order to minimize an amount of ink of a recorded image transferred to the spurs 42, since the spurs 42 come in contact with the recorded surface of the recording sheet P.

The recording sheet P is transported by the transport roller 36 and pinch roller 37 until the front end thereof is supported by the discharge rollers 41*a* and the spurs 42 while being sandwiched therebetween. After the rear end of the recording sheet P passes over the pinch roller 37, the recording sheet P is transported by the discharge rollers 41*a* and the spurs 42, and then is discharged and stored in a discharge tray 100.

The platen 34 has a plurality of projected ribs 34*a* formed on the upper surface thereof along the transport direction of the recording sheet P and supports the plurality of spurs 42, each disposed downstream of a corresponding projected rib 34*a*. Since the projected ribs 34*a* on the platen 34 and the corresponding spurs 42 are arranged on the same lines parallel to the transport direction of the recording sheet P in order to suppress the raised height of any cockled recording sheet P, wherein the cockling of the recording sheet P can occur when ink is applied on the recording sheet P, cockling having a concave shape is formed at every portion of the recording sheet between the adjacent projected ribs 34*a*, thereby minimizing the raised height of the cockled sheet lying in the recording area.

Such cockling is likely to occur especially when a permeable dye-type color ink is applied on the wide area of the recording sheet P. In the ink-jet recording device, the affect of the cockling must be eliminated and the gap between the recording sheet P and the recording head 7 must be maintained with the above arrangement in order to perform effective recording.

In recent years, a pigmentary black ink is used to increase black image density in the ink-jet recording device. The pigmentary ink requires a substantial time period for drying and fixing after the ink is applied on the recording sheet P. With this requirement, such pigmentary ink may cause a smear phenomenon in that a wet image formed on the previously discharged sheet is smeared by the currently discharging sheet because the front portion of the discharging sheet rubs the upper surface of the previously discharged sheet.

As shown in FIG. 15, a discharge section 4 of the recording device 1 has a discharge support 47 for preventing such smearing. The discharge support 47 supports the recording sheet that has been recorded, and extends the time period, from the applying time of ink on the recording sheet P to the arrival time of the recording sheet P at the discharge tray 100, for drying the ink applied on the previously discharged sheet.

In the known recording device 1, the platen 34 has the discharge support 47 that can be retracted therein. As shown in FIG. 15, the discharge support 47 usually retracts into the platen 34, and is pulled out and protrudes from the platen 34 at the time of recording. A plurality of the discharge supports 47 is disposed between the adjacent spurs 42.

While protruding from the platen 34, all the discharge supports 47 guide the recording sheet P upward higher than the surface of the recording sheet P lying in the recording area and support the discharging sheet P so that it bends downwardly at its central portion under its own weight. The known recording device 1 provided with the discharge supports 47 extends the time period from the recording time to the arrival time of the recording sheet P at the discharge tray 100.

However, in the known recording device 1 provided with the foregoing discharge supports 47, some of the discharge supports 47 raise the cockling in the recording area, thereby causing the recording sheet P to form a convex shape instead of a concave shape of the cockling between the adjacent spurs 42, and resulting in the substantially raised portions of the recording sheet P in the recording area. This causes the surface of the recording sheet P to come in contact with the recording head 7 or the carriage 50, giving rise to problems such that the surface of the recording sheet gets dirty or the recording head 7 is damaged.

SUMMARY OF THE INVENTION

The present invention can provide a recording device, provided with a discharge support, in which the parts of the device are easily fabricated, a large space for the discharge support is not needed, and a required flatness of the upper surface of the platen is easily obtained.

The present invention can also provide a recording device that comprises (a) a recording head for performing recording on a recording medium, (b) a support for supporting the recording medium downstream from the recording head in the transport direction of the recording medium, (c) a guide for supporting the support and (d) a holder for holding the guide. The guide protrudes from and retracts toward the holder substantially in the transport direction of the recording medium, and the support protrudes from and retracts toward the guide in a direction different from the protruding direction of the guide.

Further objects, features and advantages of the present invention will become apparent from the following description of the preferred embodiments with reference to the attached drawings.

DESCRIPTION OF THE PREFERRED EMBODIMENTS

With reference to the accompanying drawings, preferred embodiments of the present invention will be described.

First Embodiment

Figure 1:
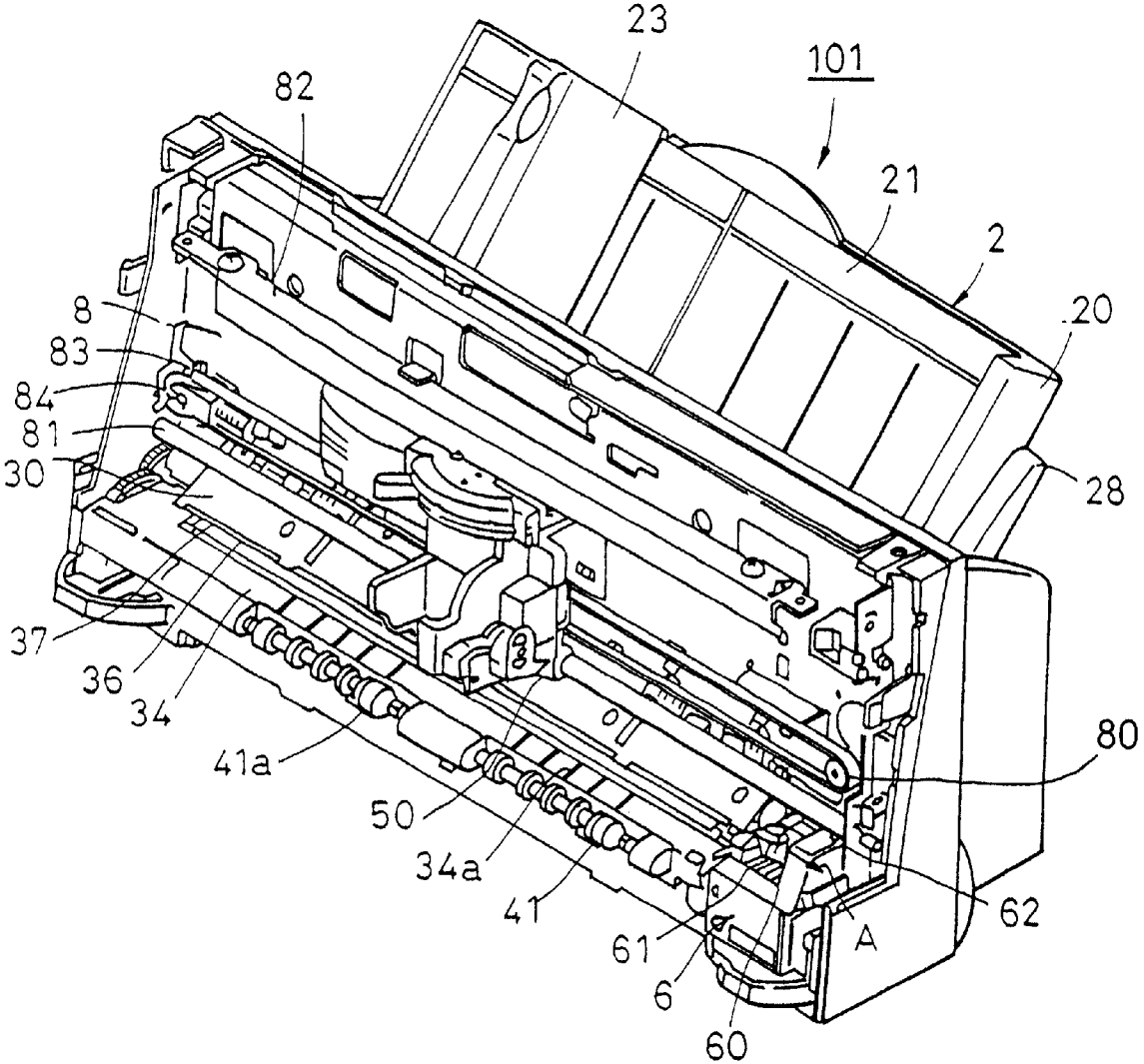
FIG. 1 is a perspective view illustrating the overall structure of a recording device according to a first embodiment of the present invention.
Figure 2:
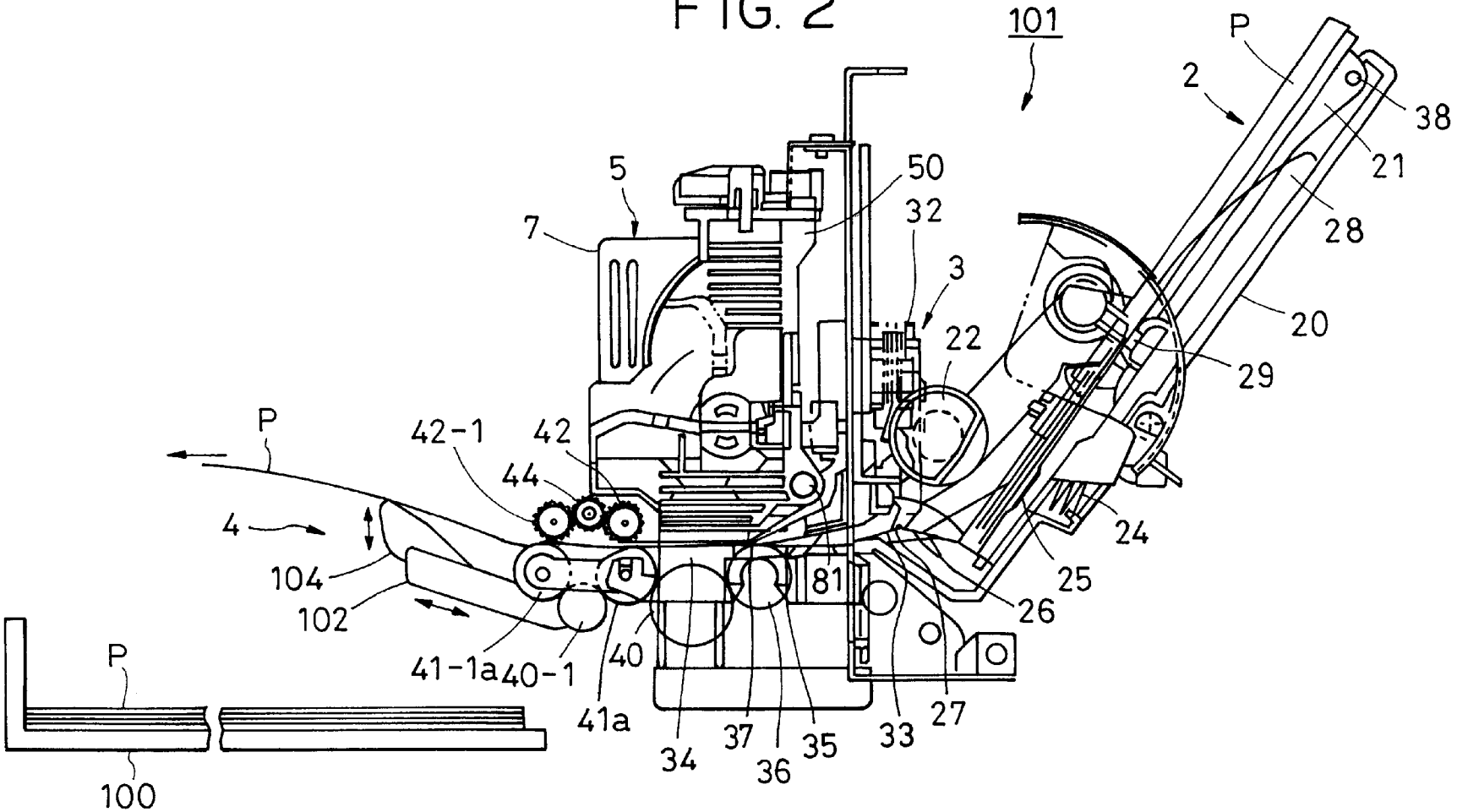
FIG. 2 is a sectional view illustrating the overall structure of the recording device according to the first embodiment of the present invention.

Referring to FIGS. 1 and 2, a recording device 101 according to a first embodiment of the present invention will be described. All the same parts are identified by the same reference numerals throughout the drawings.

As shown in FIGS. 1 and 2, the recording device 101 has a feeding section 2, a transport section 3, a discharge section 4, a carriage section 5, and a cleaning section 6. Referring to FIGS. 1 and 2, first the feeding section 2, the transport section 3, the carriage section 5, and the cleaning section 6 will be described in that order, and then the discharge section 4, which characterizes the recording device 101 of the first embodiment, will be described in detail.

(1) Feeding Section

The feeding section 2 has a base 20, a pressure plate 21 for stacking recording sheets P, and a feeding roller 22 for feeding each recording sheet P, the latter two being attached to the base 20. The pressure plate 21 has a movable side guide 23 mounted thereon for adjusting the stacking position of the recording sheets P. The pressure plate 21 is connected to the base 20 rotatably about a shaft 38 and is urged to the feeding roller 22 via a pressure spring 24. The pressure plate 21 has a separation pad 25 mounted on a portion thereof that opposes the feeding roller 22, wherein the pad 25 is made from a material such as artificial leather having a large frictional coefficient for preventing double feeding of the recording sheets P.

In addition, the base 20 has a separation claw 26 for individually separating the recording sheets P, a mound 27 integrally formed therewith for separating media such as a pasteboard and the like, which are not readily separated by the separation claw 26, a switching lever 28 for allowing the separation claw 26 to work at a normal paper position and for preventing it from working at a pasteboard position, and a release cam 29 for releasing the abutment between the pressure plate 21 and the feeding roller 22.

When the recording device 101 is in a stand-by mode, the release cam 29 pushes the pressure plate 21 down to a predetermined position so that the abutment between the pressure plate 21 and the feeding roller 22 is released. When a drive force of a transport roller 36 is transmitted to the feeding roller 22 and the release cam 29 by a gear and the like in this mode, the release cam 29 detaches from the pressure plate 21, allowing the pressure plate 21 to be elevated, thereby allowing the feeding roller 22 to abut against the recording sheet P. Then, rotation of the feeding roller 22 causes the recording sheet P to be picked up, and the feeding operation of the recording sheet P starts.

The fed recording sheets P are separated individually by the separation claw 26 and are transported to the transport section 3. The feeding roller 22 and the release cam 29 rotate so as to complete transportation of the recording sheet P to the transport section 3, and the recording device 101 returns to the stand-by mode in which the abutment between the recording sheet P and the feeding roller 22 is released and the drive force of the transport roller 36 is removed.

(2) Transport Section

The transport section 3 has the transport roller 36 for transporting the recording sheet P and a paper end sensor (hereinafter, abbreviated as a PE sensor) 32. The transport roller 36 has an idle pinch roller 37 which abuts thereagainst and which is rotatably held by a pinch roller guide 30. The pinch roller guide 30 is urged by a pinch roller spring 31 so as to press-contact the pinch roller 37 to the transport roller 36, thus producing a transport force for transporting the recording sheet P.

The transport section 3 has an upper guide 33 for guiding the recording sheet P and a platen 34 disposed at the entrance thereof to which the recording sheet P is transported. The upper guide 33 has a PE sensor lever 35 thereon for informing the PE sensor 32 of a detection of a front end and a rear end of the recording sheet P.

With the foregoing configuration, the recording sheet P transported to the transport section 3 is conveyed to a pair of rollers consisting of the transport roller 36 and the pinch roller 37, while being supported by the platen 34 and being guided by the pinch roller guide 30, and the upper guide 33. In this stage, the PE sensor 32 detects the front end of the transported-recording sheet P on the basis of information from the PE sensor lever 35. The recording device 101 determines the location of a recording area of the detected-recording sheet P with respect to the detected front end.

The recording sheet P is transported onto the platen 34 by rotation of the pair of rollers 36 and 37 driven by a line feed motor (hereinafter, abbreviated as an LF motor) (not shown). A recording head 7 has an ink tank detachably mounted thereon and can apply heat to ink supplied from the ink tank using a heater and the like as an electricity-energy converter. The heat causes film-boiling of the ink in the recording head 7, and the film-boiling causes a bubble to grow or shrink. As a result of a pressure change generated by the growth or shrinkage of the bubble, an ink drop is discharged from a nozzle of the recording head 7, thereby forming an image on the recording sheet P.

(3) Carriage Section

The carriage section 5 has a carriage 50 on which the recording head 7 is mounted. The carriage 50 is supported by a guide shaft 81 for allowing the recording head 7 to scan back and forth in a direction orthogonal to the transport direction of the recording sheet P, and a guide rail 82 for maintaining the clearance between the recording head 7 and the recording sheet P by holding the rear end of the carriage 50. The guide shaft 81 and the guide rail 82 are mounted on a chassis 8.

The carriage 50 is driven by a carriage motor 80 mounted on the chassis 8 via a timing belt 83. The timing belt 83 is stretched and supported by an idle pulley 84. The carriage 50 has a flexible circuit board (not shown) mounted thereon for transmitting a recording signal from an electrical circuit board (not shown) in the recording device 101 to the recording head 7. Attachment and detachment of the recording head 7 to and from the carriage 50 and of the ink tank to and from the recording head 7 are performed at a given position to which the carriage 50 moves when an operation key (not shown) is pressed.

With this configuration, when an image is to be formed on the recording sheet P, the pair of rollers 36 and 37 transports the recording sheet P to a line position where the image is to be formed (a position on a line in the transport direction of the recording sheet P), and the carriage motor 80 drives the carriage 50 to move to a row position where the image is to be formed (a position on another line orthogonal to the transport direction of the recording sheet P) such that the recording head 7 faces a position where the image is to be formed. Then, the recording head 7 discharges ink drops toward the recording sheet P in response to a recording signal received from the electrical circuit board and thereby forms the image.

(4) Cleaning Section

The cleaning section 6 has a pump 60 for cleaning the recording head 7, a cap 61 for preventing the recording head 7 from drying, and a drive switching arm 62 for switching a drive force of the transport roller 36 to either one of the feeding section 2 and the pump 60.

Since the drive switching arm 62 has a planetary gear (not shown) which rotates about the axial center of the transport roller 36 that is fixed at a predetermined position thereof, the drive force of the transport roller 36 is not transmitted to the feeding section 2 and the pump 60 when operations other than feeding and cleaning are performed in the recording device 101.

When the drive switching arm 62 is moved in the direction of arrow A indicated in FIG. 1 by movement of the carriage 50, the planetary gear becomes free and moves in response to the normal rotation or reverse rotation of the transport roller 36. That is to say, the drive force is transmitted to the feeding section 2 or the pump 60 when the transport roller 36 rotates normally or reversely, respectively.

(5) Discharge Section

The discharge section 4 has first and second discharge rollers 41*a* and 41-1*a*, a first transmission roller 40 abutting against the first discharge rollers 41*a*, and a second transmission roller 40-1 abutting against the second discharge rollers 41-1*a*. The drive force of the transport roller 36 is transmitted to the first discharge rollers 41*a* via the first transmission roller 40 and is then transmitted to the second discharge rollers 41-1*a* via the second transmission roller 40-1. The first discharge rollers 41*a* have first spurs 42 abutting thereagainst and the second discharge rollers 41-1*a* have second spurs 42-1 abutting thereagainst, each arranged for rotation driven by the first discharge rollers 41*a* and the second discharge rollers 41-1*a*, respectively. The first and second spurs 42 and 42-1 have a cleaning roller 44 rotatably abutted thereagainst.

With the foregoing configuration, the recording sheet P, having the image formed thereon at the carriage section 5, is transported while being interposed between a pair of the discharge rollers 41*a* and 41-1*a* and another pair of the spurs 42 and 42-1, and then is discharged to a discharge tray 100.

In addition, the second discharge rollers 41-1*a* have discharge supports 104, for supporting the discharged recording sheet P, disposed downstream therefrom. The discharge supports 104 are rotatably attached to a guide 102. The guide 102 protrudes from and retracts toward the platen 34. The discharge supports 104 rotate in accordance with the linear motion of the guide 102. The recording device 101 according to the first embodiment has five discharge supports 104 arranged in the width direction of the recording sheet P.

Figure 3:
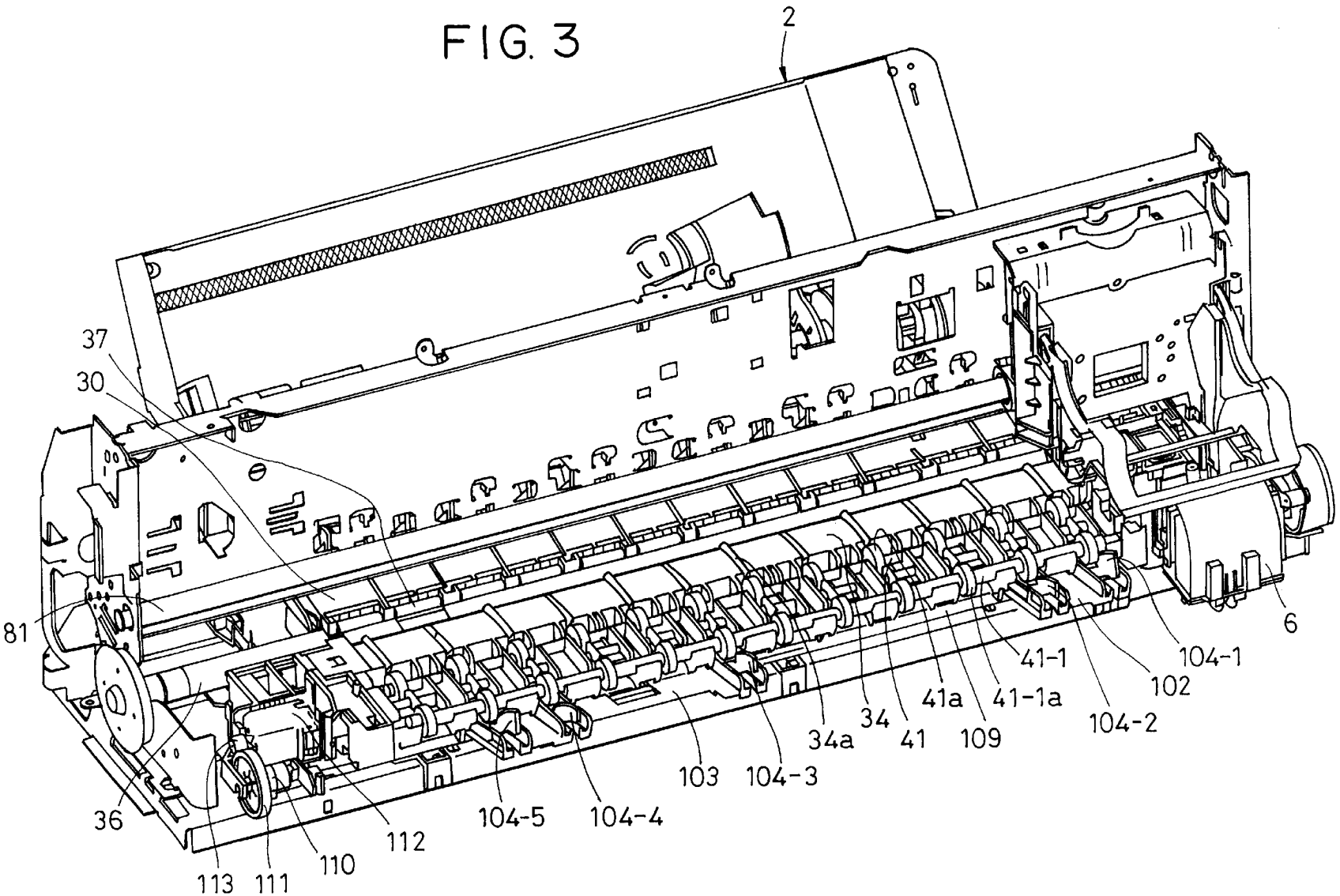
FIG. 3 is another perspective view illustrating the overall structure of the recording device according to the first embodiment of the present invention.
Figure 4:
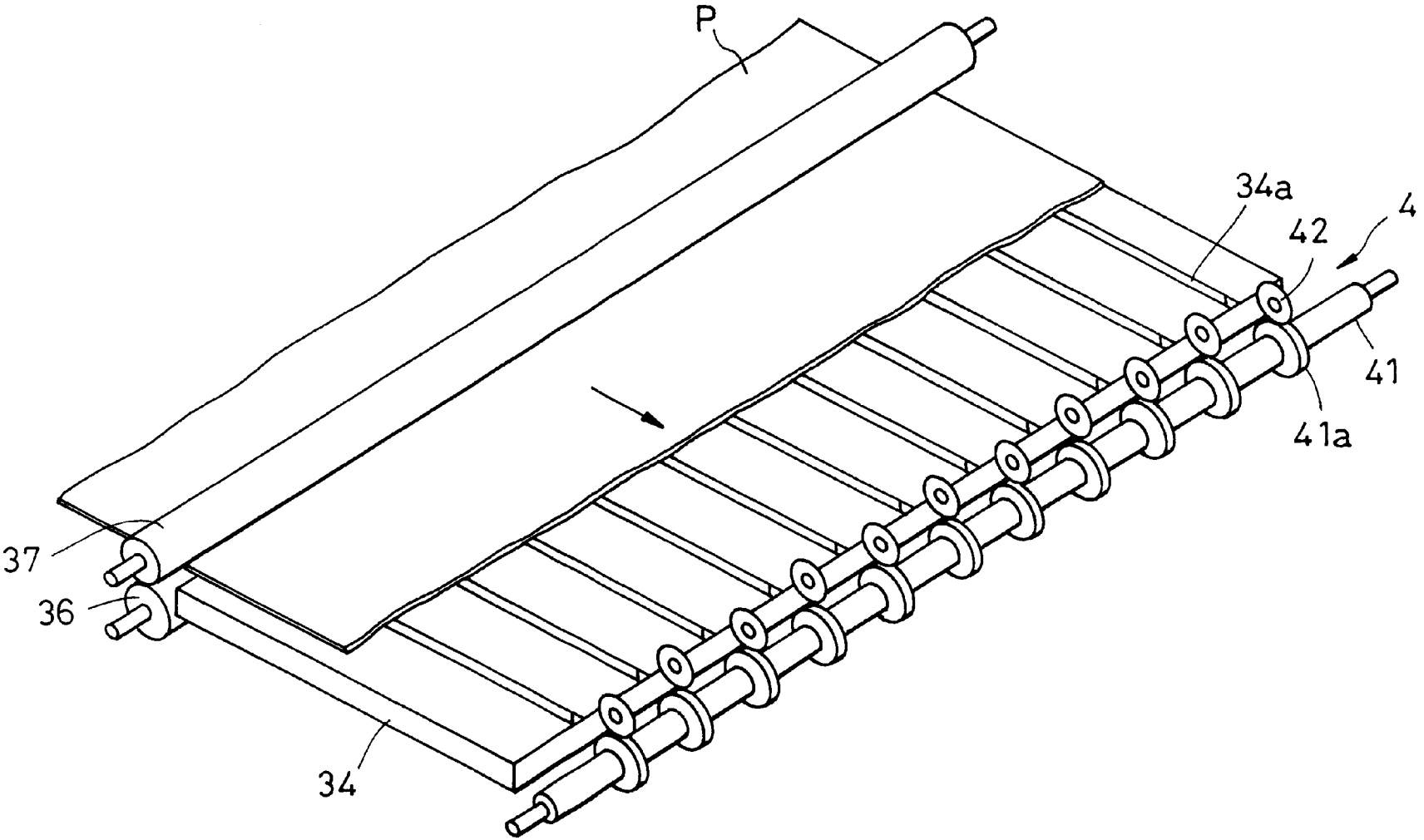
FIG. 4 is a perspective view schematically illustrating the positional relationship among a transport roller, a pinch roller, spurs, discharge rollers and so forth of the recording device according to the first embodiment of the present invention.
Figure 5:
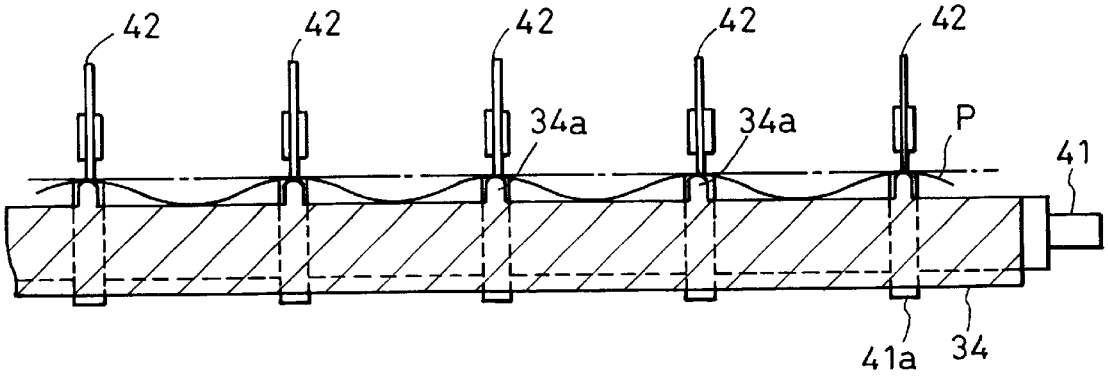
FIG. 5 is a sectional view schematically illustrating the positional relationship among the spurs, the discharge rollers and so forth of the recording device according to the first embodiment of the present invention.
Figure 6:
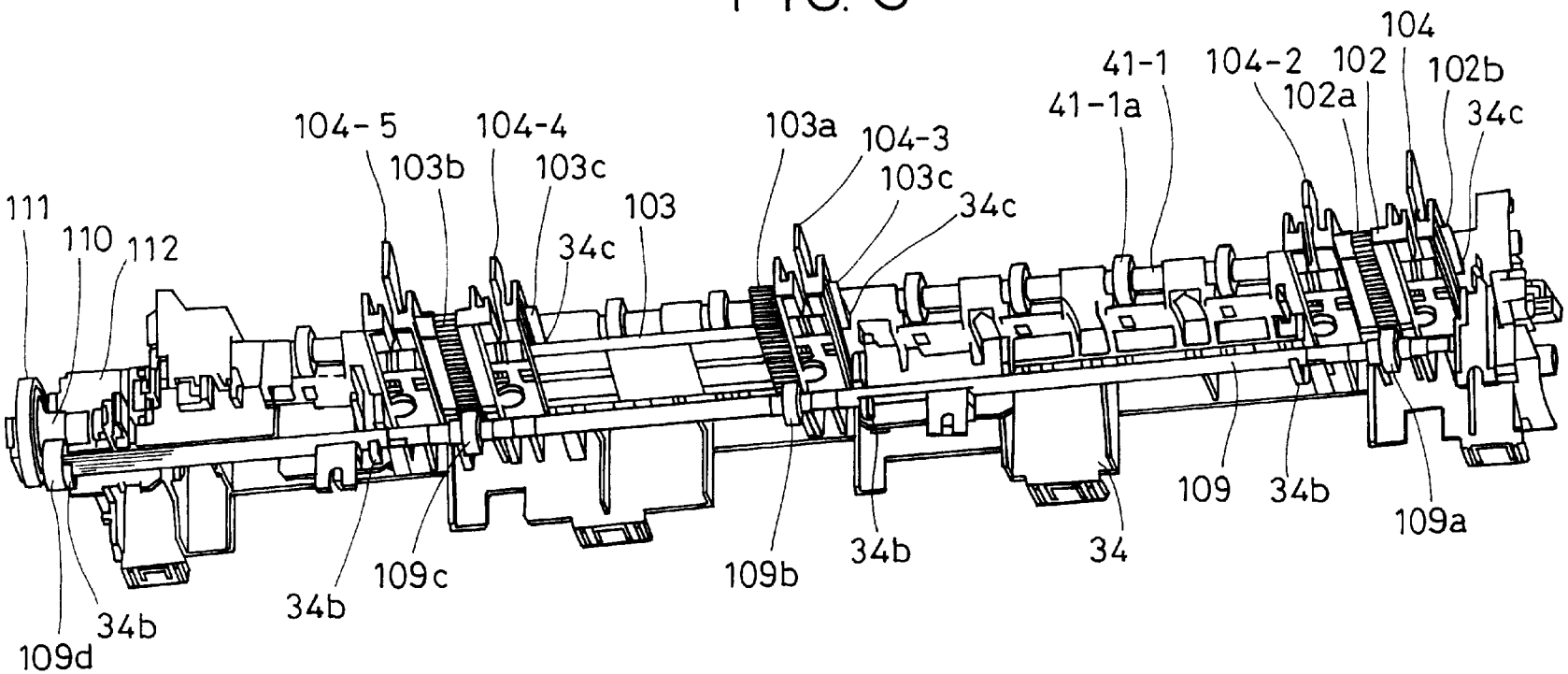
FIG. 6 is a perspective view illustrating a discharge section of the recording device viewed from the bottom thereof according to the first embodiment of the present invention.
Figure 7:
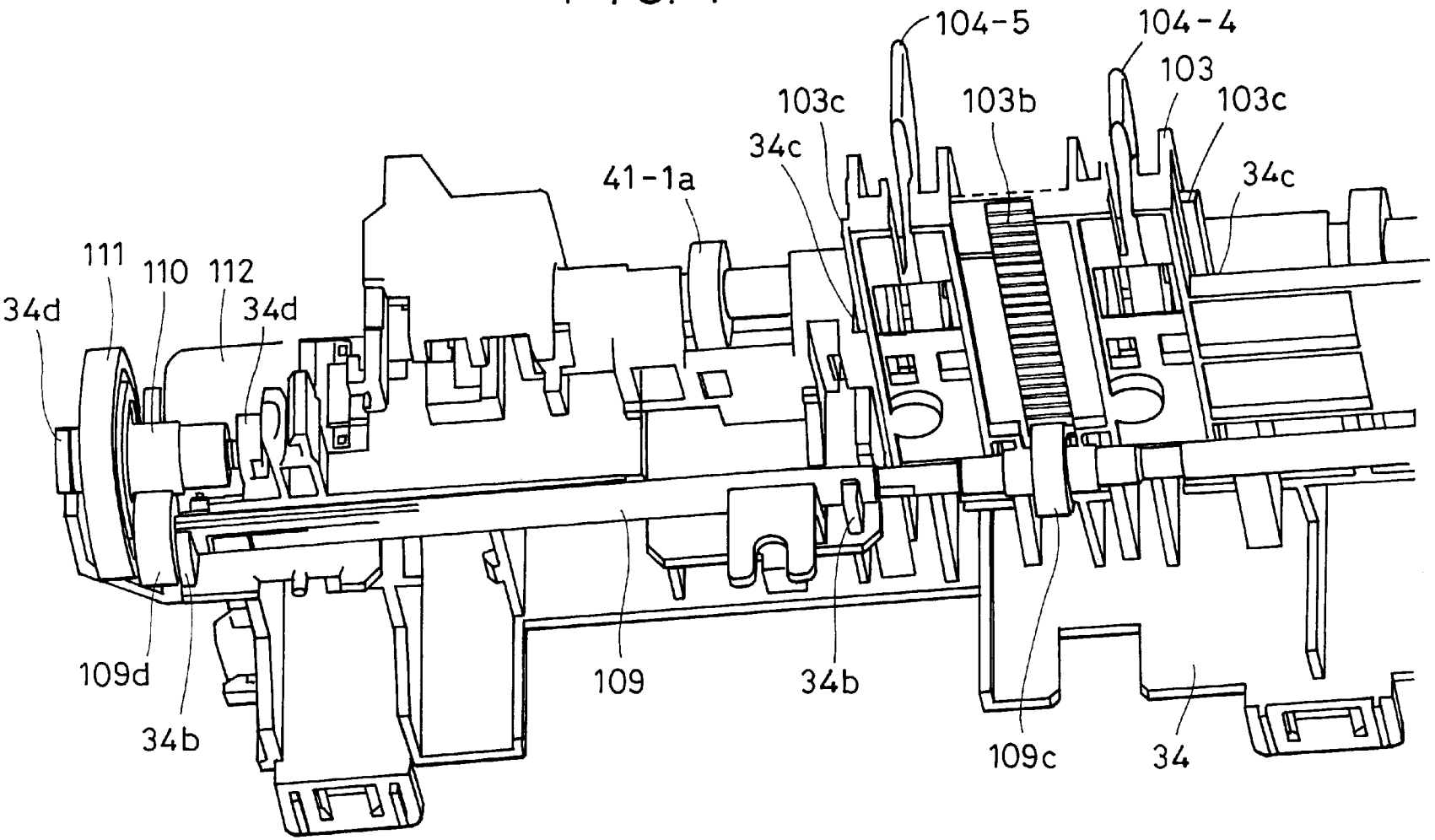
FIG. 7 is a partially enlarged view of FIG. 6.
Figure 8:
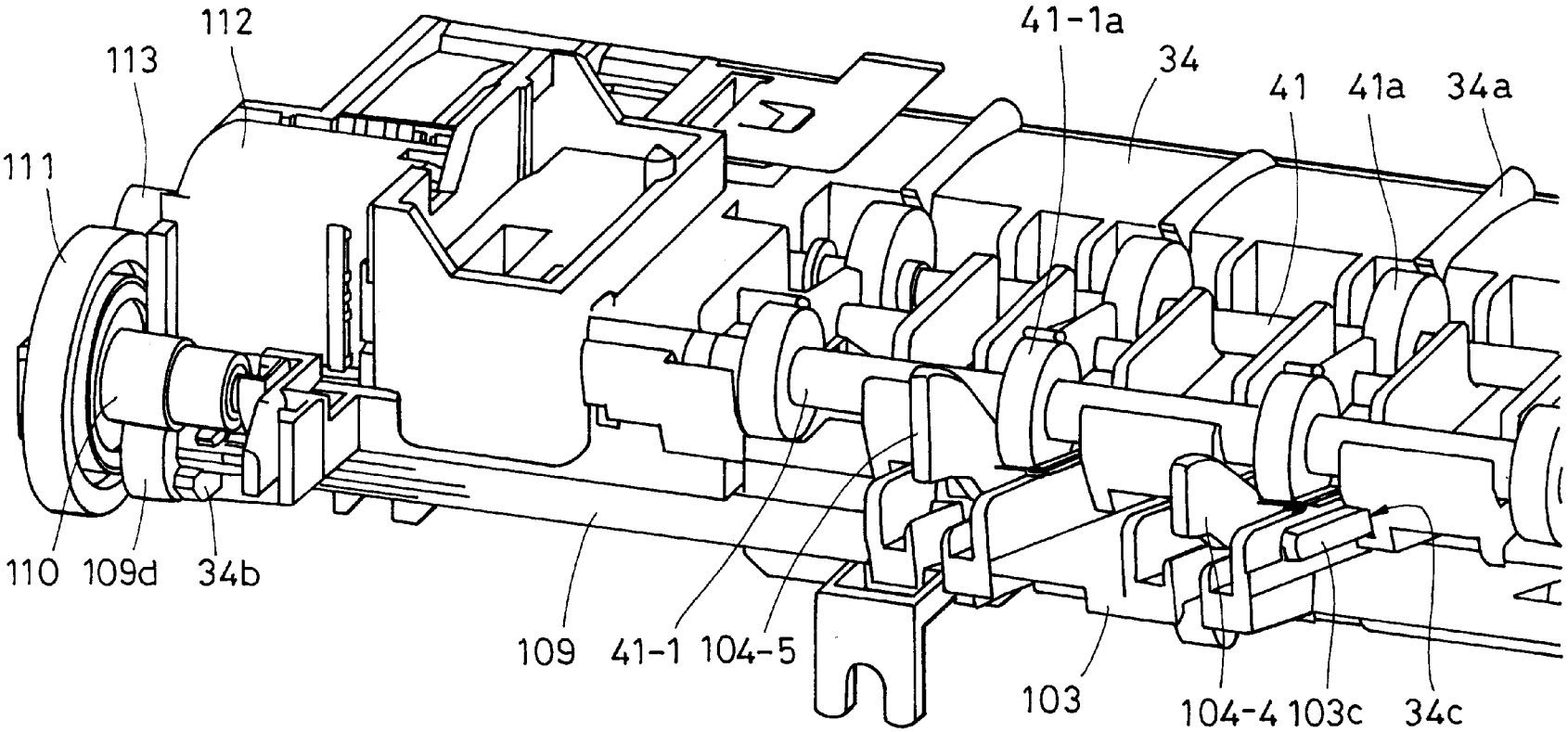
FIG. 8 is a partially enlarged view illustrating a driving section for driving discharge supports of the recording device according to the first embodiment of the present invention.
Figure 9:
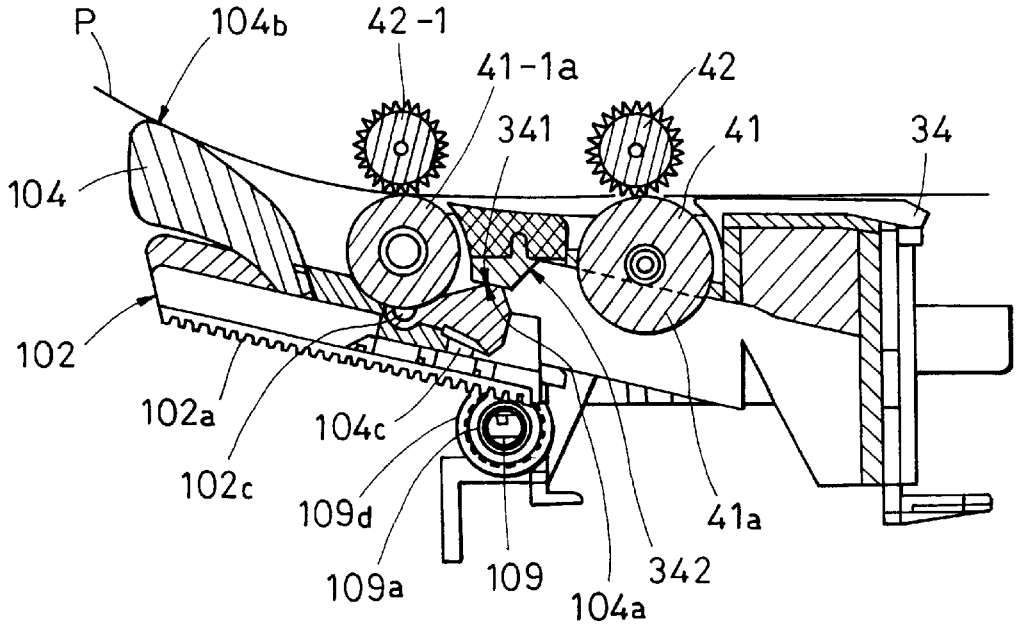
FIG. 9 is an illustration of a state in which one of the discharge supports protrudes from a platen and supports a recording sheet.
Figure 10:
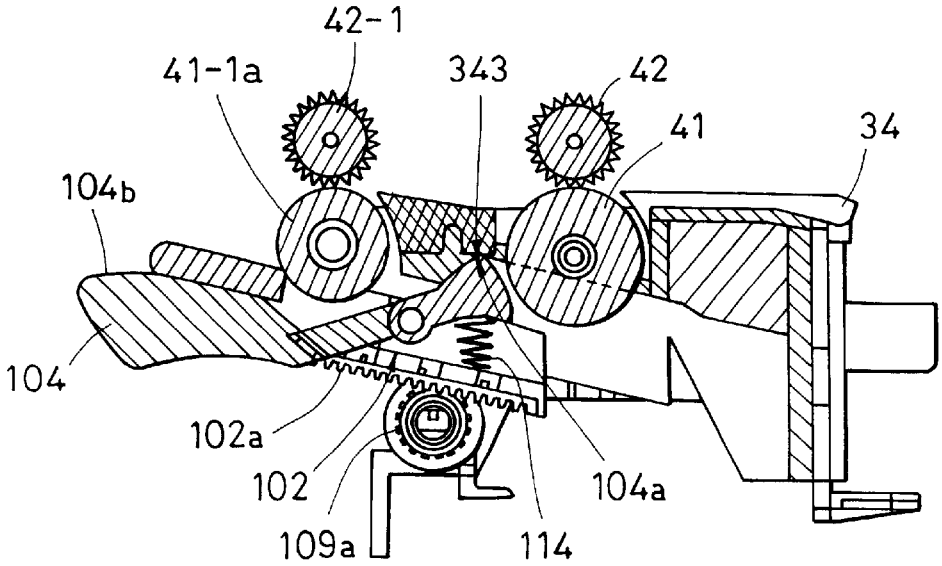
FIG. 10 is an illustration of another state in which a recording sheet support portion as a downstream part of the discharge support lies at the lowest position and a guide protrudes from or retracts toward the platen.
Figure 11:
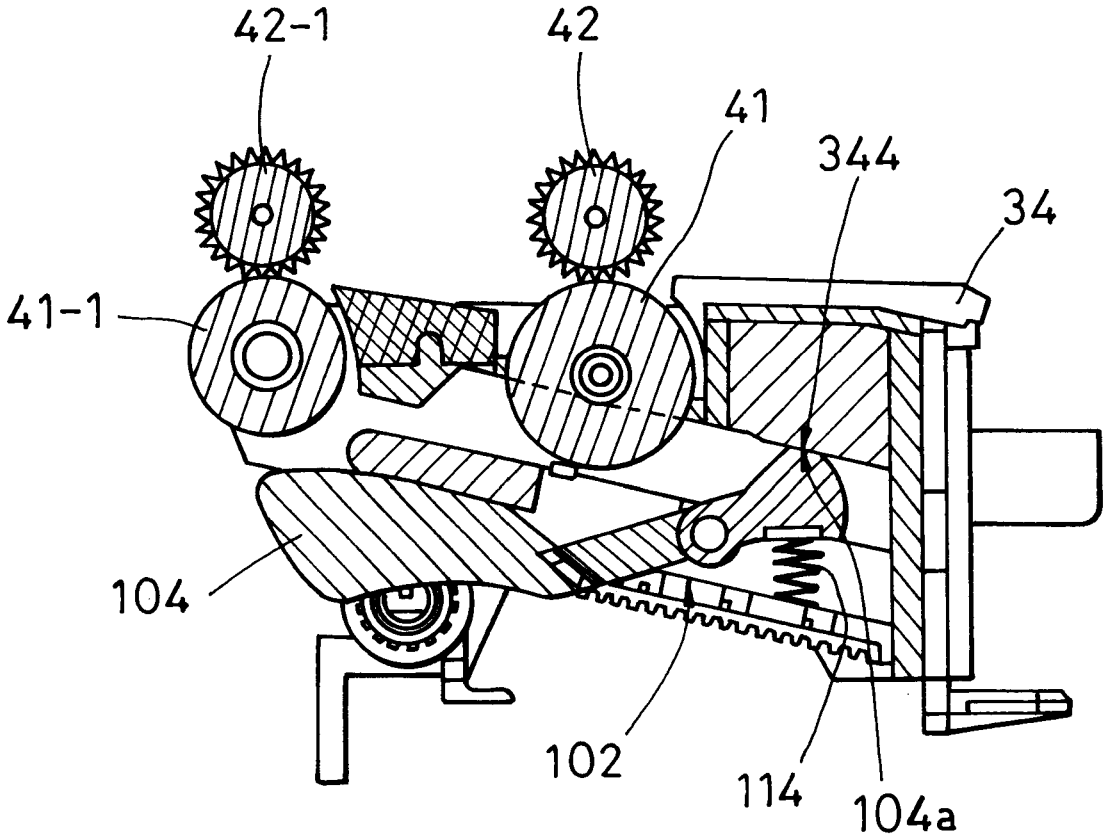
FIG. 11 is an illustration of yet another state in which the guide has retracted toward the platen.

Referring now to FIGS. 3 to 11, the structure and operations of the discharge section 4 of the recording device 101 according to the first embodiment will be described. FIG. 3 is a perspective view illustrating the overall structure of the recording device 101. FIG. 4 is a perspective view schematically illustrating the positional relationship among the transport roller 36, the pinch roller 37, the spurs 42, the discharge rollers 41*a* and so forth of the recording device 101. FIG. 5 is a sectional view schematically illustrating the positional relationship among the spurs 42, the discharge rollers 41*a* and so forth of the recording device 101. FIG. 6 is a perspective view illustrating the discharge section 4 of the recording device 101 viewed from the bottom thereof. FIG. 7 is a partially enlarged view of FIG. 6. FIG. 8 is a partially enlarged view illustrating a driving section for driving the discharge supports 104 of the recording device 101. FIGS. 9 to 11 are sectional views of the discharge section 4 illustrating operations of the discharge section 4 of the recording device 101.

As shown in FIG. 3, the platen 34 has a plurality of projected ribs 34*a* formed on the upper surface thereof extending along the transport direction of the recording sheet P and having a predetermined pitch in the width direction of the recording sheet P. The platen 34 has the first and second discharge rollers 41*a* and 41-1*a* downstream thereof arranged along the transport direction of the recording sheet P and in the width direction of the recording sheet P, each roller 41*a* and each roller 41-1*a* being aligned on the same line of the corresponding projected rib 34*a*. The second discharge rollers 41-1*a* have the corresponding discharge supports 104 downstream therefrom.

With the foregoing configuration, in a recording area, the recording sheet P is properly positioned away from the recording head 7 by the transport roller 36 and the pinch roller 37 and also by the first discharge rollers 41*a* and the first spurs 42. Thus, a combination of the first discharge rollers 41*a* and the first spurs 42 and another combination of the second discharge rollers 41-1*a* and the second spurs 42-1 support the recording sheet P by sandwiching it therebetween and then discharge it.

In the recording device 101, aligning each of the projected ribs 34*a* on the platen 34, the corresponding first spur 42, second spur 42-1, and discharge support 104 substantially on the same line along the transport direction of the recording sheet P and aligning like components in the width direction of the recording sheet P allows the recording sheet P to form concave cockling at the time of recording between the adjacent projected ribs 34*a*. FIG. 5 illustrates a state in which the concave cockling occurs at the time of recording between the adjacent projected ribs 34*a* on the platen 34.

Next, the structure of the discharge supports 104 of the recording device 101 according to the first is embodiment will be described. The discharge supports 104 are supported by the guide 102 and a guide 103 and protrude from and retract toward the platen 34. Once the discharge supports 104 have protruded from the platen 34, the discharge supports 104 guide and support the recording sheet P upward from the horizontal surface on which a part of the recording sheet P lying in the recording area is supported.

The recording sheet P of A-4 size is supported by the discharge supports 104-1 to 104-3 and the recording sheet P of A-3 size is supported by all the discharge supports 104-1 to 104-5. The discharge supports 104 support the recording sheet P so that the central portion of the recording sheet P warps downward under its own weight. In the recording device 101, the discharge supports 104-1 and 104-5 have the same shape, and the discharge supports 104-2 and 104-4 have the other same shape, taking the A-3 size width as a basic structure.

In a state in which the discharge supports 104 protrude from the platen 34, the downstream highest portions, i.e., the recording sheet support portions, of the discharge supports 104-1 and 104-5 are higher than those of the discharge supports 104-2 and 104-4. Also, the recording sheet P of A-4 size is supported by the discharge supports 104-1 to 104-3 as described above, and the downstream highest portion of the discharge support 104-3 is slightly higher than that of the discharge support 104-2.

In the recording device 101, when moderate density recording is performed on the recording sheet P of A-3 size, the recording sheet P is supported by the discharge supports 104-1, 104-3, and 104-5. When high print density recording is performed on the above recording sheet P, the recording sheet P is also supported by the discharge supports 104-2 and 104-4 so as to prevent it from becoming buckled and thereby jackknifed between the discharge supports 104-1 and 104-5. In this embodiment, the downstream highest portion of the discharge support 104-3 is set to be higher than those of the discharge supports 104-2 and 104-4; however, it may be as high as or lower than those of the discharge supports 104-2 and 104-4.

As shown in FIG. 9, the discharge supports 104-1 and 104-2 are supported by the guide 102 in a rotatable manner about a shaft 102*c* of the guide 102. Likewise, the discharge supports 104-3 to 104-5 are supported by the guide 103 in a rotatable manner about a shaft (not shown) of the guide 103.

The recording sheet support portions 104*b* of the discharge supports 104 have a gradual upward-canted shape toward their downstream ends. After the front end of the recording sheet P that has been recorded abuts against the recording sheet support portions 104*b*, the recording sheet P is supported by the recording sheet support portions 104*b* and thus is transported smoothly. Also, each of the discharge supports 104 has a cam crest 104*a* at its upstream end for determining a vertical position of the recording sheet support portion 104*b* at its downstream end by abutting against cam rails 341 to 344 of the platen 34 that will be described later. Furthermore, each of the discharge supports 104 has a boss 104*c* at the underside of its upstream end. As shown in FIGS. 10 and 11, each of the discharge supports 104 and the guide 102 have a spring 114 inserted therebetween so that the cam crest 104*a* abuts against the cam rails 341 to 344 all the time.

As shown in FIG. 8, the guide 103 has guide rails 103*c* on both sides thereof abutting against guide grooves 34*c* disposed on the platen 34. The guide 103 protrudes from and retracts toward the platen 34 by its guide rails 103*c* slideably and linearly moving along the guide grooves 34*c* of the platen 34. Likewise, the guide 102 protrudes from and retracts toward the platen 34 by slideably and linearly moving along guide rail 102*b* and the guide grove 34*c* of the platen 34 (FIG. 6). As shown in FIGS. 6 and 7, the guide 103 has two projected guide rails 103*c* thereon, engaging with the respective guide grooves 34*c* of the platen 34.

Also, the guide 102 has a rack 102*a* at the bottom thereof and the guide 103 has two racks 103*a* and 103*b* at the bottom thereof. The platen 34 has a drive shaft 109 rotatably supported by a bearing 34*b* disposed on the platen 34. Engaging pinion gears 109*a*, 109*b*, and 109*c* provided on the drive shaft 109 with the racks 102*a*, 103*a*, and 103*b*, respectively, of the guides 102 and 103 allows the guides 102 and 103 to move.

With the foregoing configuration, the guides 102 and 103 move linearly so as to protrude from and retract toward the platen 34 by a rotation of the drive shaft 109. The guides 102 and 103 are positioned in desired positions (not shown) when protruding from the platen 34.

The drive shaft 109 has a gear 109*d* disposed at one end thereof. Transmission gears 110 and 111 are rotatably supported by a bearing 34*d* (FIG. 7) disposed on the platen 34.

The transmission gear 111 is coaxially arranged with the transmission gear 110 and engages with a motor gear 113 of a motor 112. The transmission gears 110 and 111 have a torque limiter (not shown) therebetween urged by a spring (not shown). This arrangement avoids cog slip between the pinion gears 109*a*, 109*b*, and 109*c* and the respectively corresponding racks 102*a*, 103*a*, and 103*b*, when the guides 102 and 103 are driven by the motor 112 and then stop upon bumping into predetermined points of the platen 34.

Operations of the discharge supports 104 will now be described. In the recording device 101, the discharge supports 104 are controlled so as to extrude prior to the start of recording by the recording head and retract upon a discharging operation of the recording sheet P after completion of recording.

In the recording device 101 according to the first embodiment, the motor 112 drives the motor gear 113 for rotation, allowing the drive force thereof to be transmitted to the transmission gear 111 and then to the drive shaft 109 via the transmission gear 110 and the gear 109*d* for rotation of the drive shaft 109. The guides 102 and 103 move linearly by engagement of the pinion gears 109*a* to 109*c* provided on the drive shaft 109 with the corresponding racks 102*a*, 103*a*, and 103*b*, respectively. The discharge supports 104 protrude from and retract toward the guides 102 and 103 in response to the movements of the guides 102 and 103.

FIG. 9 illustrates a state in which the discharge support 104 protrudes from the platen 34 and supports the recording sheet P. FIG. 10 illustrates a state in which the recording sheet support portion 104*b* at the downstream end of the discharge support 104 lies at its lowest point and the guide 102 is protruding from or retracting toward or into the platen 34. FIG. 11 illustrates a state in which the guide 102 has retracted into the platen 34.

As shown in FIG. 11, when the guide 102 retracts toward the platen 34, the discharge support 104 has retracted to the guide 102. In this stage, the cam crest 104*a* has abutted against the cam rail 344 of the platen 34 urged by the spring 114.

As shown in FIG. 10, rotation of the pinion gear 109*a* of the drive shaft 109 allows the rack 102*a* engaging with the pinion gear 109*a* to move and thereby the guide 102 to start protruding. The cam crest 104*a* of the discharge support 104 slides along the cam rails 344 and 343 of the platen 34 against the force of the spring 114.

When the recording sheet support portion 104*b* of the discharge support 104 passes the second discharge roller 41-1*a* and the cam crest 104*a* abuts against a sloped cam rail 342, the cam crest 104*a* is lowered and the recording sheet support portion 104*b* of the discharge support 104 is gradually raised. Then, as shown in FIG. 9, the recording sheet support portion 104*b* reaches its highest position while the cam crest 104*a* abuts against the lowest surface of the cam rail 341. The guide 102 bumps into a predetermined point of the platen 34 and stops, allowing the recording sheet support portion 104*b* of the discharge supports 104 to be held at a predetermined point. After the front end of the recording sheet P passes the second spur 42-1, the recording sheet P abuts against the slope of the discharge support 104, is transported along the slope, and is supported by the downstream lowest point of the discharge support 104.

Timing for protrusion and retraction of the discharge supports 104 and the guides 102 and 103 is controlled by control means (not shown) on the basis of sizes of the recording sheets P, timing for recording in the recording area, and so forth.

Although the recording device 101 according to the first embodiment initiates protrusion of the discharge supports 104 before the recording head 7 starts recording, the recording device 101 may initiate protrusion of the discharge supports 104 during recording as long as the protrusion does not affect the recorded image.

When a thick special sheet such as a pasteboard, on which high quality recording is required and which has little potential for cockling, is used as a recording medium, high stiffness of the sheet itself has a negative effect on the angle of the sheet around the recording area thereof because of the slope of the discharge supports 104. Therefore, in this case, the recording device 101 may control recording and discharging of the recording sheet P without the discharge supports 104 protruding from the platen 34.

Also, though the recording device 101 according to the first embodiment has the guides 102 and 103 facing the recording head 7 so as to protrude from and retract toward the platen 34 for supporting the recording sheet P, the recording device 101 may be provided with a special holder (not shown) downstream thereof, in addition to the platen 34, for holding the guides 102 and 103, and may be configured such that the guides 102 and 103 protrude from and retract toward the holder.

According to the first embodiment, since each of the projected ribs 34*a* on the platen 34, the corresponding first spur 42 and first discharge roller 41*a* are aligned on the same line along the transport direction of the recording sheet P and like components are aligned in the width direction of the recording sheet P, the shape of any generated cockling is not affected by the discharge supports 104. Also, the guides are provided so as to protrude from and retract toward the platen, and the discharge supports are provided so as to protrude from and retract toward the guides, thereby providing discharge supports without employing a complicated mechanism.

Second Embodiment

Figure 12:
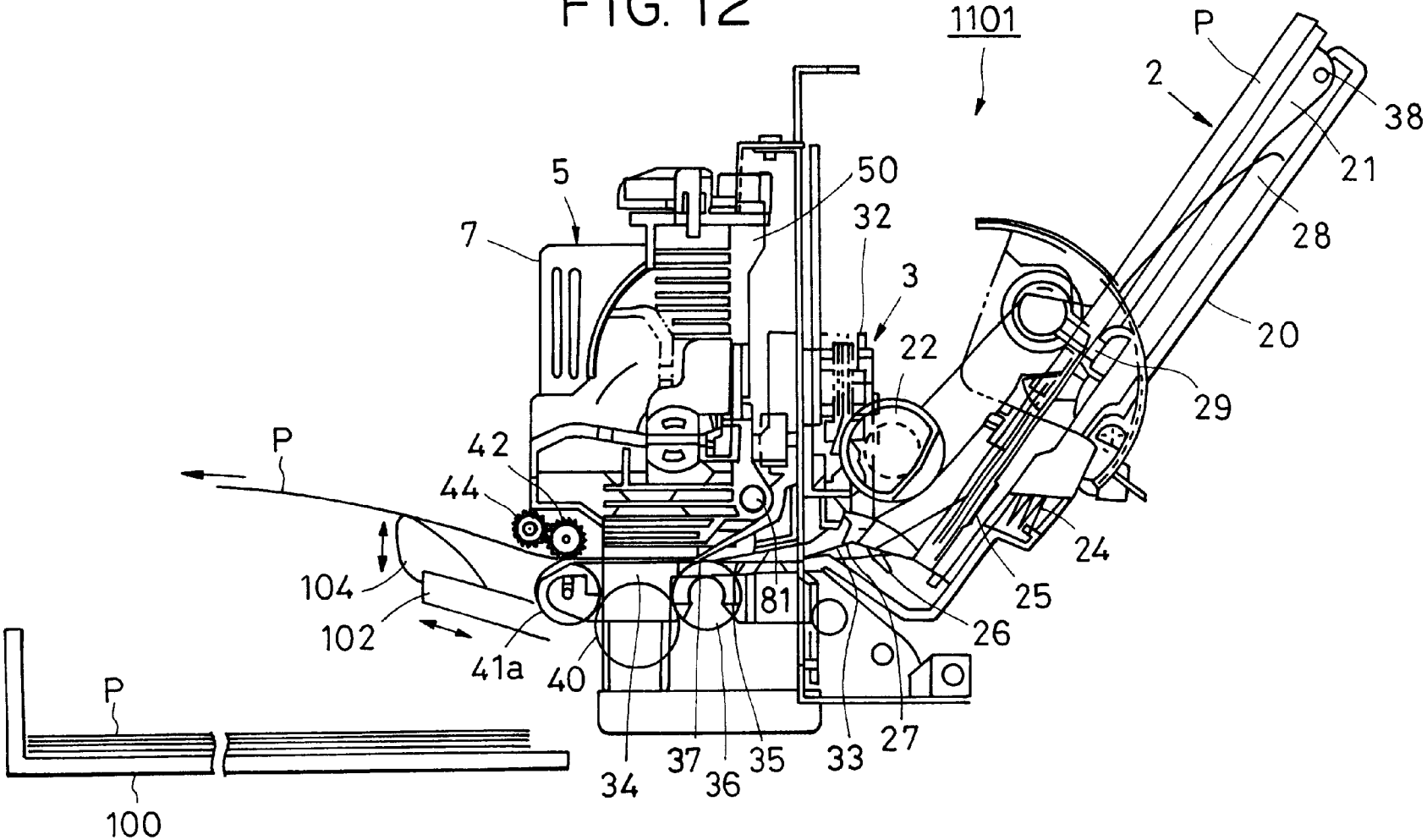
FIG. 12 is a sectional view illustrating the overall structure of a recording device according to a second embodiment of the present invention.

A recording device according to a second embodiment of the present invention will be described. FIG. 12 is a sectional view illustrating the configuration of a recording device 1101 according to the second embodiment. As shown in FIG. 12, the discharge roller and the spur are disposed in a row, making the device of the second embodiment different from that of the first embodiment.

In the recording device 1101, a drive force of the transport roller 36 is transmitted to the discharge roller 41*a* via the transmission roller 40 at the discharge section 4. The discharge support 104 is disposed on the same line with the spur 42 along the transport direction of the recording sheet P and two or more discharge supports are disposed across the width direction of the recording sheet P. Operations of the recording device 1101 are the same as those of the recording device 101.

According to the second embodiment, the recording device 1101 having a set of the discharge roller 41*a* and the spur 42 which are disposed in a row requires a further smaller space for the discharge support 104 than that of the recording device 101 according to the first embodiment.

Third Embodiment

Figure 13:
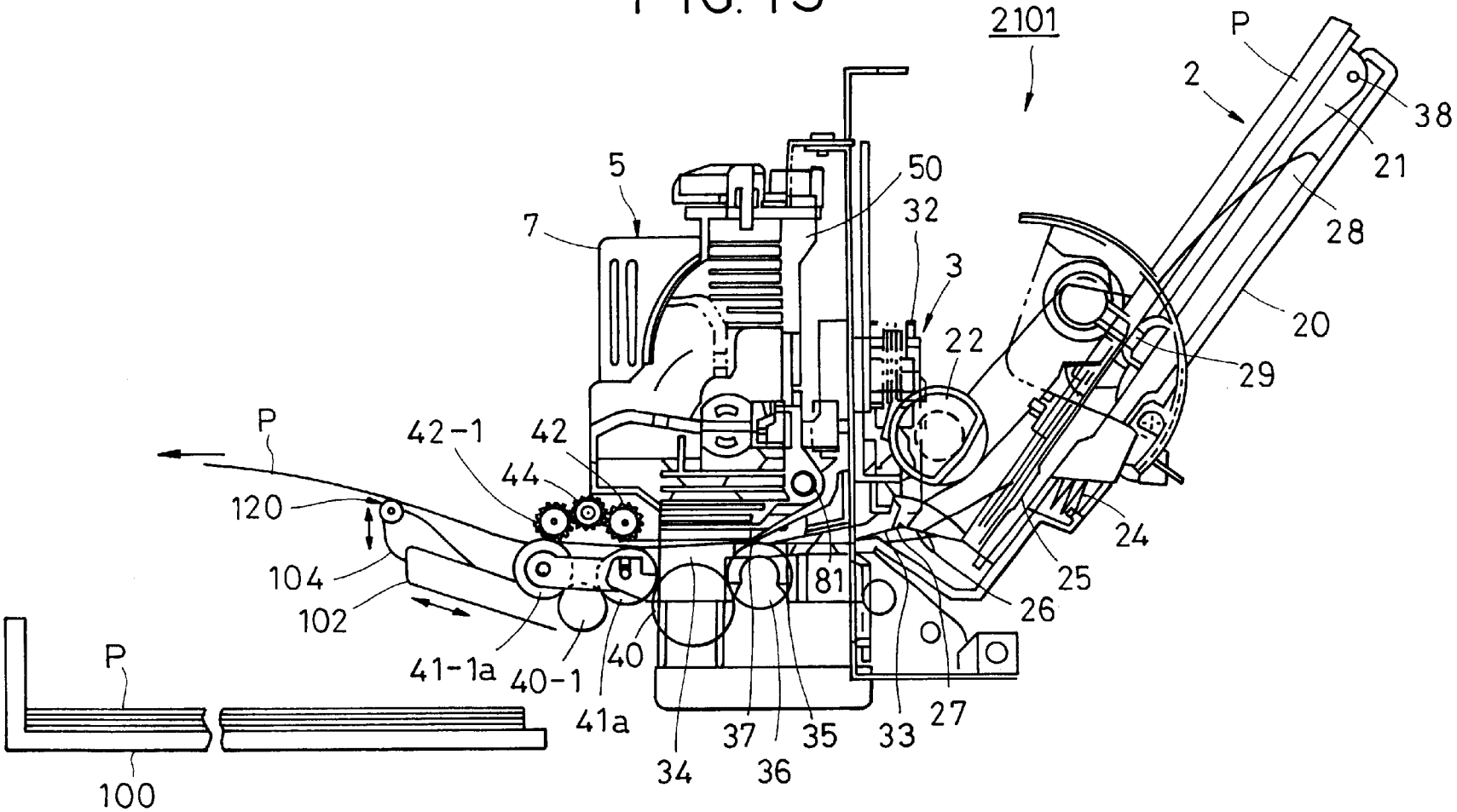
FIG. 13 is a sectional view illustrating the overall structure of a recording device according to a third embodiment of the present invention.
Figure 14:
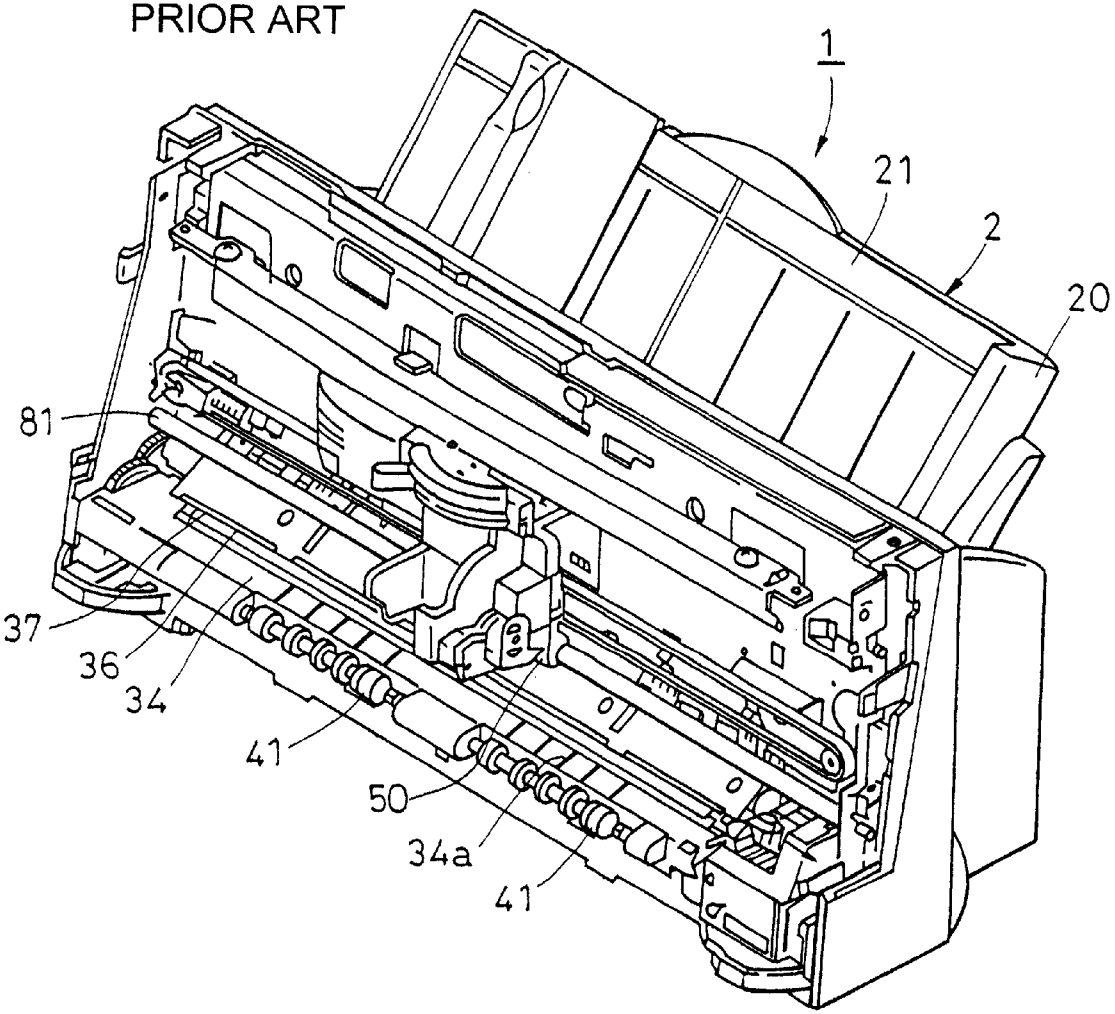
FIG. 14 PRIOR ART
FIG. 14 is a perspective view illustrating the overall structure of a known ink-jet recording device.
Figure 15:
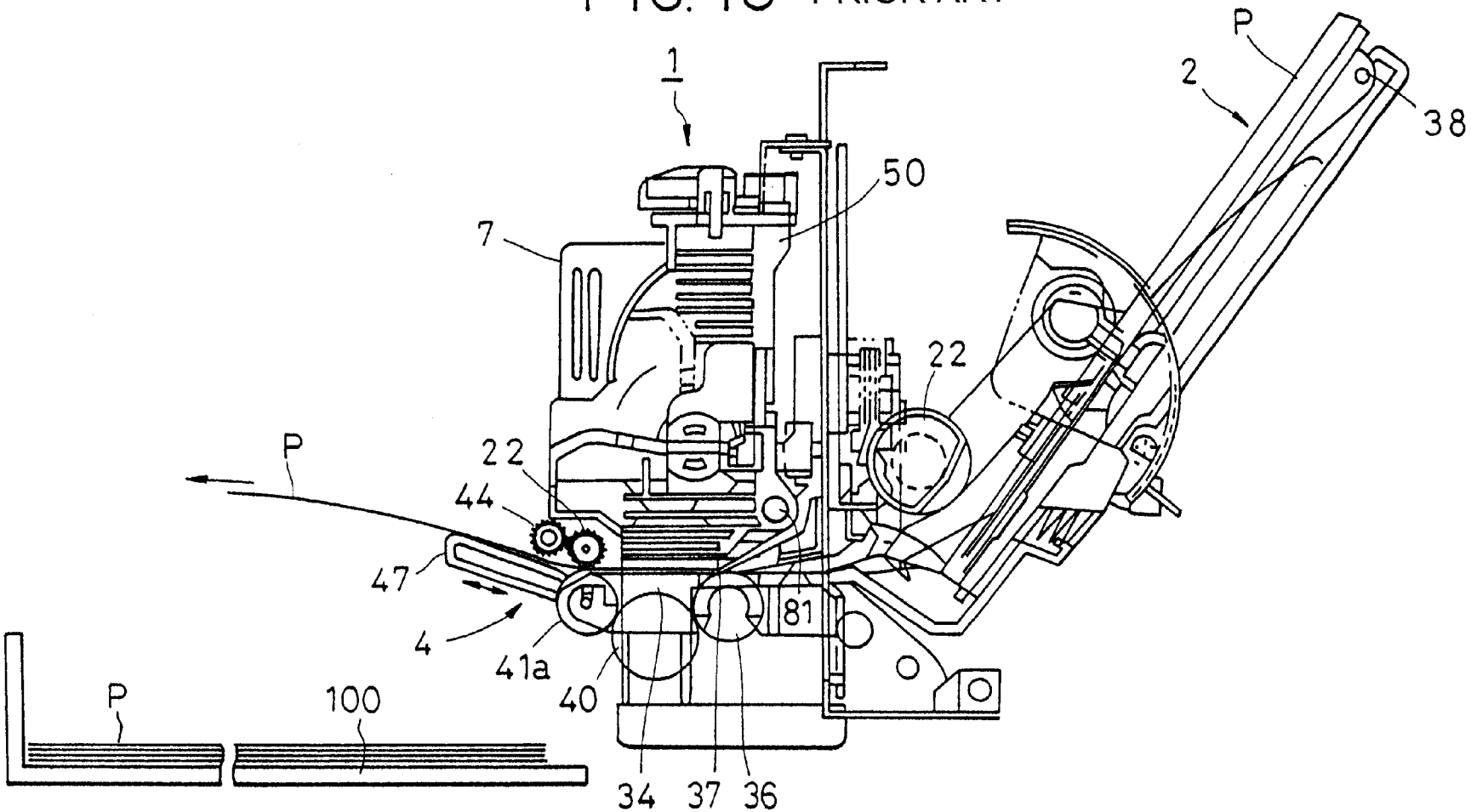
FIG. 15 PRIOR ART
FIG. 15 is a sectional view illustrating the overall structure of the known ink-jet recording device.
Figure 16:
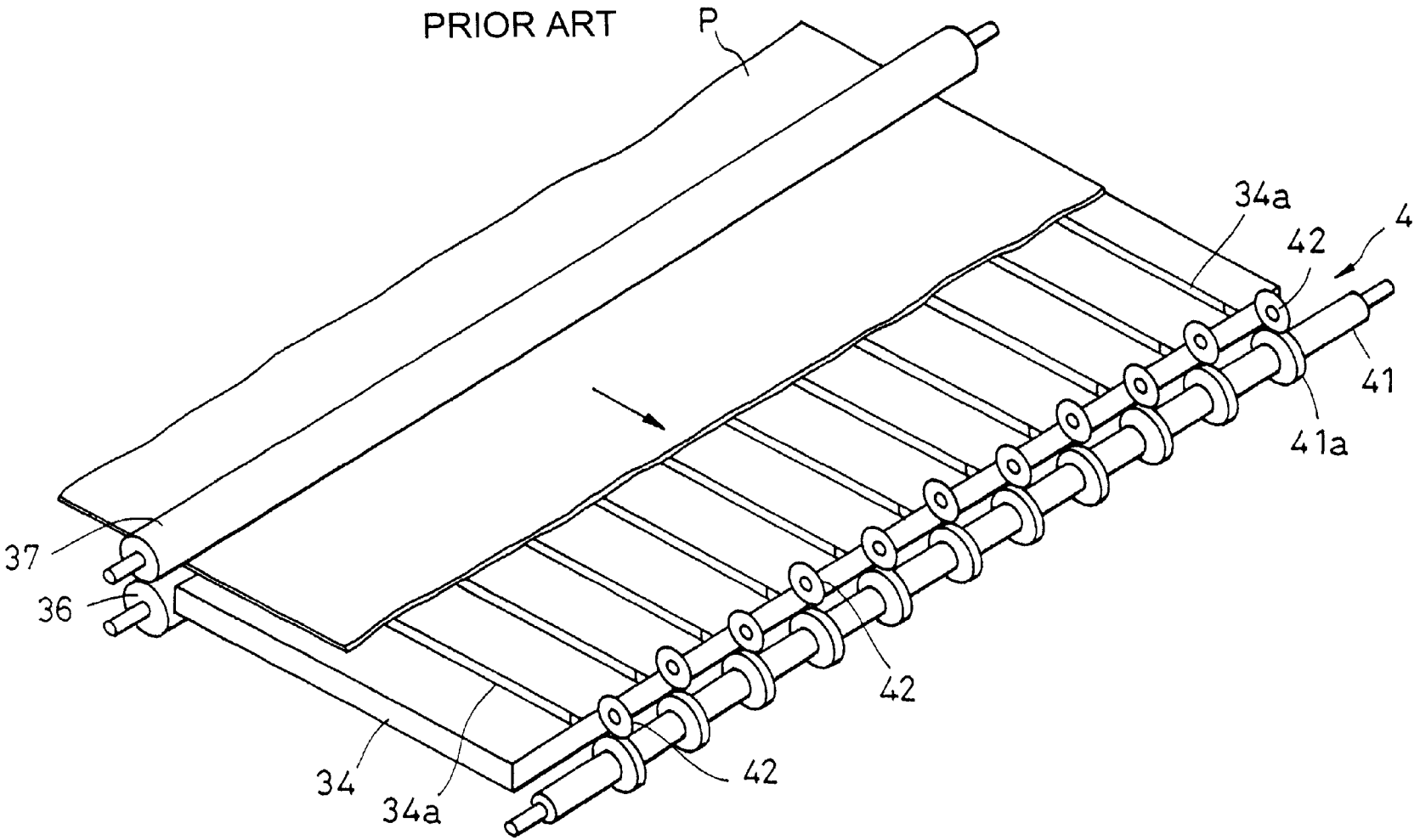
FIG. 16 PRIOR ART
FIG. 16 is a perspective view schematically illustrating the positional relationship among a transport roller, a pinch roller, spurs, discharge rollers and so forth in the known ink-jet recording device.
Figure 17:
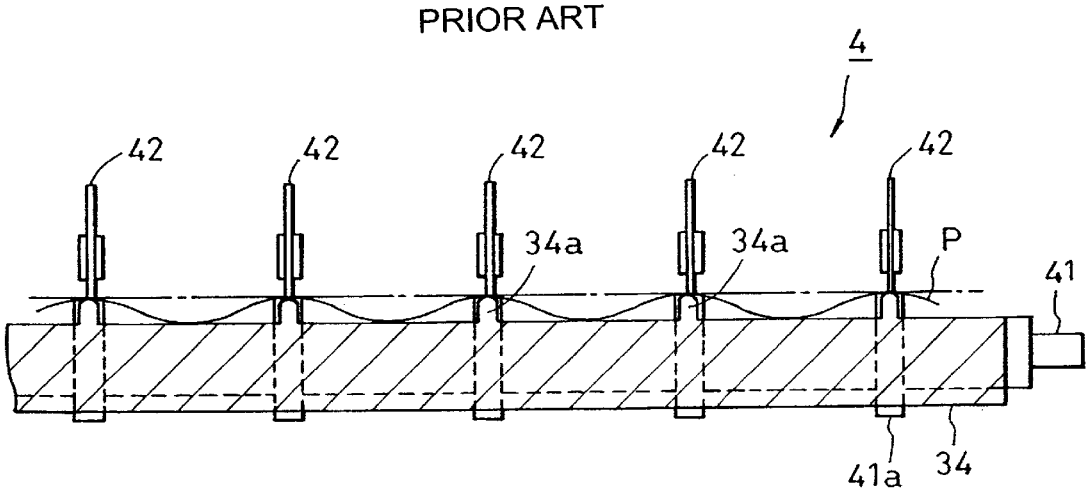
FIG. 17 PRIOR ART
FIG. 17 is a sectional view schematically illustrating the positional relationship among the spurs, discharge rollers and so forth in the known ink-jet recording device.

A recording device according to a third embodiment of the present invention will be described. FIG. 13 is a sectional view illustrating the configuration of a recording device 2101 according to the third embodiment. As shown in FIG. 13, the recording device 2101 has a roller 120 rotatably mounted at a downstream portion of the discharge support 104. Supporting the recording sheet P by the roller 120 leads to reduction in the friction caused by transporting the recording sheet P. Operations of the recording device 2101 are the same as those of the recording device 101.

According to the third embodiment, the recording device 2101 having a roller 120 at a downstream portion of the discharge support 104 accurately transports the recording sheet P, thereby providing a high-quality recorded image.

The foregoing discharge support mechanism is applicable to a recording device provided with a recording head employing an electrothermal converter or a piezo-electric element. One skilled in the art will appreciate that the discharge mechanism is also applicable to a recording device provided with a recording head other than an ink-jet type.

In the recording device according to the third embodiment, the guide protrudes from and retracts toward the platen and the discharge support protrudes from and retracts toward the guide, providing the discharge support without employing a complicated mechanism. This configuration allows the discharge support to move in a smaller working area when the discharge support is aligned substantially on the same line with the discharge roller or the spur along the transport direction of the recording sheet, with two or more discharge supports disposed across the width direction of the recording sheet.

The smaller working area of the discharge support increases the strength of the platen, making it easy to achieve a required flatness of each rib formed on the upper surface of the platen, thereby leading to maintaining a certain amount of gap between the recording head and the recording sheet P.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for recording on a recording medium with a recording head, said recording apparatus comprising:

a platen for supporting the recording medium at a position facing the recording head;

a guide capable of protruding from and retracting toward said platen in the transport direction of the recording medium; and a discharge support capable of protruding from and retracting toward said guide in a different direction from a protruding direction of said guide, wherein said discharge support supports the recording medium when the recording medium recorded by the recording head is discharged outside of said recording apparatus.

2. The recording apparatus according to claim 1, wherein said discharge support is rotatable relative to said guide and protrudes from and retracts toward said guide in accordance with movement of said guide protruding from and retracting toward said platen.

3. The recording apparatus according to claim 1, wherein said discharge support comprises a recording medium support portion, and wherein said recording medium support portion is disposed closer to said recording head than a support surface of the recording medium, the support surface being supported in the recording region, when said discharge support is in a protruded position, and said support surface is disposed farther from the recording head than the support surface when said discharge support is in a retracted position.

4. The recording apparatus according to claim 1, further comprising control means for controlling said guide and said discharge support, wherein said control means controls said guide and said discharge support in response to a transport location of the recording medium.

5. The recording apparatus according to claim 4, wherein said control means controls said guide and said discharge support to protrude before said recording head starts recording on the recording medium or while said recording head is performing recording on the recording medium, and said control means controls said guide and said discharge support to retract after said recording head completes recording on the recording medium or while said recording head is not performing recording on the recording medium.

6. The recording apparatus according to claim 1, wherein said discharge support comprises a plurality of discharge support units arranged in a width direction of the recording medium so as to support both sides of at least one standard recording medium.

7. The recording apparatus according to claim 6, wherein when protruded, said discharge support supports an outer portion of the recording medium at a position higher than the central portion of the recording medium.

8. The recording apparatus according to claim 1, further comprising a discharge roller for transporting the recording medium, wherein said discharge support is aligned substantially on the same line as said discharge roller along the transport direction of the recording medium.

9. The recording apparatus according to claim 1, wherein the recording head is an ink-jet recording head for discharging ink.

10. The recording apparatus according to claim 9, wherein said ink-jet recording head comprises an electrothermal converter for generating heat to be applied to the ink to eject the ink.

11. The recording apparatus according to claim 1, wherein said guide is driven by a rack and gear mechanism.

12. The recording apparatus according to claim 1, wherein said discharge support is driven by a cam and follower mechanism.

13. The recording apparatus according to claim 1, wherein movement of said discharge support is interrelated with movement of said guide.

14. A recording device comprising:

recording means for performing recording on a recording medium;

support means for supporting the recording medium downstream from said recording means in the transport direction of the recording medium;

guide means for supporting said support means; and holding means for holding said guide means, wherein said guide means protrudes from and retracts toward said holding means substantially in the transport direction of the recording medium, and said support means protrudes from and retracts toward said guide means in a direction different from the protruding direction of said guide means.

15. The recording device according to claim 14, wherein said support means supports the recording medium that is discharged from a recording region.

16. The recording device according to claim 14, further comprising control means for controlling said guide means and said support means, wherein said control means controls said guide means and said support means in response to a transport location of the recording medium.

17. The recording device according to claim 16, wherein said control means controls said guide means and said support means to protrude before said recording means starts recording on the recording medium or while said recording means is performing recording on the recording medium, and said control means controls said guide means and said discharge support means to retract after said recording means completes recording on the recording medium or while said recording means is not performing recording on the recording medium.

18. The recording device according to claim 14, wherein said support means supports an outer portion of the recording medium in a position higher than the central portion of the recording medium.

* * * * *